US007119757B1

(12) United States Patent
Lopez

(10) Patent No.: US 7,119,757 B1
(45) Date of Patent: Oct. 10, 2006

(54) DUAL-ARRAY TWO-PORT DIFFERENTIAL GPS ANTENNA SYSTEMS

(75) Inventor: Alfred R. Lopez, Commack, NY (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 168 days.

(21) Appl. No.: 10/921,661

(22) Filed: Aug. 19, 2004

(51) Int. Cl.
*H01Q 21/20* (2006.01)
*H01Q 21/00* (2006.01)

(52) U.S. Cl. ..... 343/816; 343/800; 343/891

(58) Field of Classification Search ..... 343/799, 343/800, 891, 793, 816
See application file for complete search history.

(56) References Cited

U.S. PATENT DOCUMENTS 5,534,882 A 7/1996 Lopez ..... 343/891
5,757,324 A * 5/1998 Helms et al. ..... 343/700 MS
6,201,510 B1 * 3/2001 Lopez et al. ..... 343/799
6,300,915 B1 10/2001 Lopez ..... 343/813

* cited by examiner

*Primary Examiner*—Tan Ho
(74) *Attorney, Agent, or Firm*—Kenneth P. Robinson

(57) ABSTRACT

Dual-array two-port GPS antenna systems can provide horizon to zenith reception for differential GPS applications. On a single mast, an antenna system may include a lower array of sub-arrays (e.g., fifteen sub-arrays) to provide elevation coverage from horizon up to about 55 degrees elevation and an upper array of sub-arrays (e.g., three sub-arrays) to provide elevation angle coverage from zenith down to about 55 degrees elevation. Each sub-array may be of the same construction including four dipoles positioned at different azimuth locations and configured to provide a progressive-phase-omnidirectional (PPO) azimuth pattern suitable for reception of circularly polarized signals. In a particular embodiment the three sub-arrays of the upper array have PPO azimuth patterns with differing azimuth alignments and differing excitation values to provide a desired elevation angle coverage characteristic.

20 Claims, 7 Drawing Sheets

DUAL-ARRAY TWO-PORT DIFFERENTIAL GPS ANTENNA SYSTEMS

RELATED APPLICATIONS (Not Applicable)

FEDERALLY SPONSORED RESEARCH (Not Applicable)

BACKGROUND OF THE INVENTION

This invention relates to antennas to receive signals from Global Positioning System (GPS) satellites and, more specifically to antenna systems arranged for reception for differential GPS applications.

Antenna systems providing a circular polarization characteristic in all directions horizontally and upward from the horizon, with a sharp cut-off characteristic below the horizon are described in U.S. Pat. No. 5,534,882, issued to A. R. Lopez on Jul. 9, 1996. Antennas having such characteristics are particularly suited to reception of signals from GPS satellites.

As described in that patent, application of the GPS for aircraft precision approach and landing guidance is subject to various local and other errors limiting accuracy. Implementation of Differential GPS (DGPS) can provide local corrections to improve accuracy at one or more airports in a localized geographical area. A DGPS ground installation provides corrections for errors, such as ionospheric, tropospheric and satellite clock and ephemeris errors, effective for local use. The ground station may use one or more GPS reception antennas having suitable antenna pattern characteristics. Of particular significance is the desirability of antennas having the characteristic of a unitary phase center of accurately determined position, to permit precision determinations of phase of received signals and avoid introduction of phase discrepancies. Antenna systems having the desired characteristics are described and illustrated in U.S. Pat. No. 5,534,882, which is hereby incorporated herein by reference.

For such applications, antennas utilizing a stack of individually-excited progressive-phase-omnidirectional elements are described in U.S. Pat. No. 6,201,510, issued to A. R. Lopez, R. J. Kumpfbeck and E. M. Newman on Mar. 13, 2001. Elements as described therein include self-contained four-dipole elements which are employed in stacked configuration to provide omnidirectional coverage from the zenith (90° elevation) to the horizon (0°) or from a high elevation angle to the horizon, with a sharp pattern cut off below the horizon. U.S. Pat. No. 6,201,510 is hereby incorporated herein by reference.

In some applications, it may be desirable to employ a set of two antennas, each providing omnidirectional coverage (in azimuth) and the antennas providing complementary coverage in elevation. For example, an antenna of the type described in U.S. Pat. No. 6,201,510 may be designed to provide omnidirectional coverage from the horizon to a specified elevation angle. If available, a second high-angle omnidirectional antenna of appropriate design and performance could be used to provide complementary elevation coverage from that elevation angle to the zenith. Used together, such antennas would provide horizon to zenith coverage for omnidirectional reception of GPS signals for DGPS applications. Available antennas for high elevation angle coverage have generally been subject to limitations in areas such as performance, size, cost, reliability or compatibility for integration into a single dual-array antenna.

Objects of the present invention are to provide new and improved antennas, including antennas usable for DGPS applications and having one or more of the following characteristics and advantages:

- dual-array two-port configuration;
- omnidirectional azimuth coverage with elevation coverage from horizon to zenith;
- high-angle elevation coverage in combination with an array providing lower elevation coverage;
- progressive-phase-omnidirectional azimuth pattern;
- reception of circularly polarized signals;
- configurable with two arrays on one mast;
- use of one common form of sub-array in dual arrays.

SUMMARY OF THE INVENTION

In accordance with the invention, a dual-array GPS antenna system is usable to provide horizon to zenith reception for differential GPS applications. The antenna system includes a vertically-extending structure supporting lower and upper arrays. The lower array may include fifteen sub-arrays supported at vertically spaced positions and each configured to enable its use to provide a progressive-phase-omnidirectional (PPO) azimuth pattern. A first excitation network may be coupled to predetermined sub-arrays of the lower array and arranged to provide an elevation pattern with elevation angle coverage nominally from horizon up to at least 55 degrees elevation, for example. The lower array may include interspersed sub-arrays which are not coupled to any excitation network. The upper array may include three sub-arrays supported at vertically spaced positions above the sub-arrays of the lower array and each configured to provide a PPO azimuth pattern. A second excitation network may be coupled to the sub-arrays of the upper array and arranged to provide an elevation pattern with elevation angle coverage nominally from zenith down to at least 55 degrees elevation, for example. Each sub-array of the lower and upper arrays may comprise four dipoles positioned with different azimuth orientations and each sub-array coupled to an excitation network may be configured to receive signals of nominally circular polarization. The antenna system may further include a first signal port coupled to the first excitation network and a second signal port coupled to the second excitation network.

For a better understanding of the invention, together with other and further objects, reference is made to the accompanying drawings and the scope of the invention will be pointed out in the accompanying claims.

DESCRIPTION OF THE INVENTION

Figure 1:
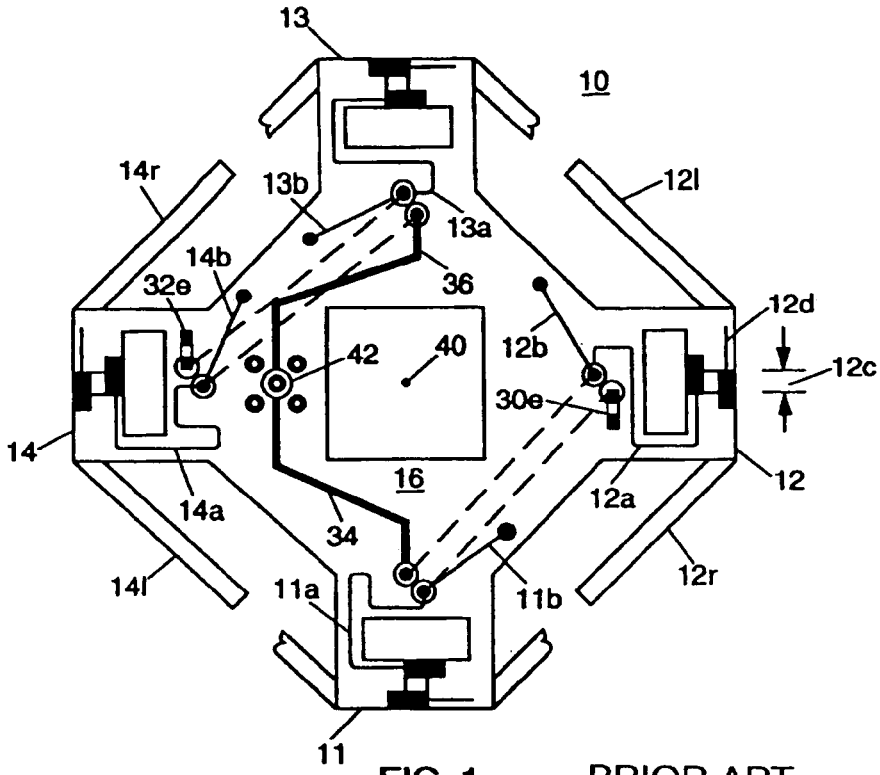
FIG. 1 PRIOR ART
FIG. 1 is a top view of a four-dipole sub-array configuration usable in antennas pursuant to the invention (two dipoles are shown with partial arms for clarity of presentation).
Figure 2:
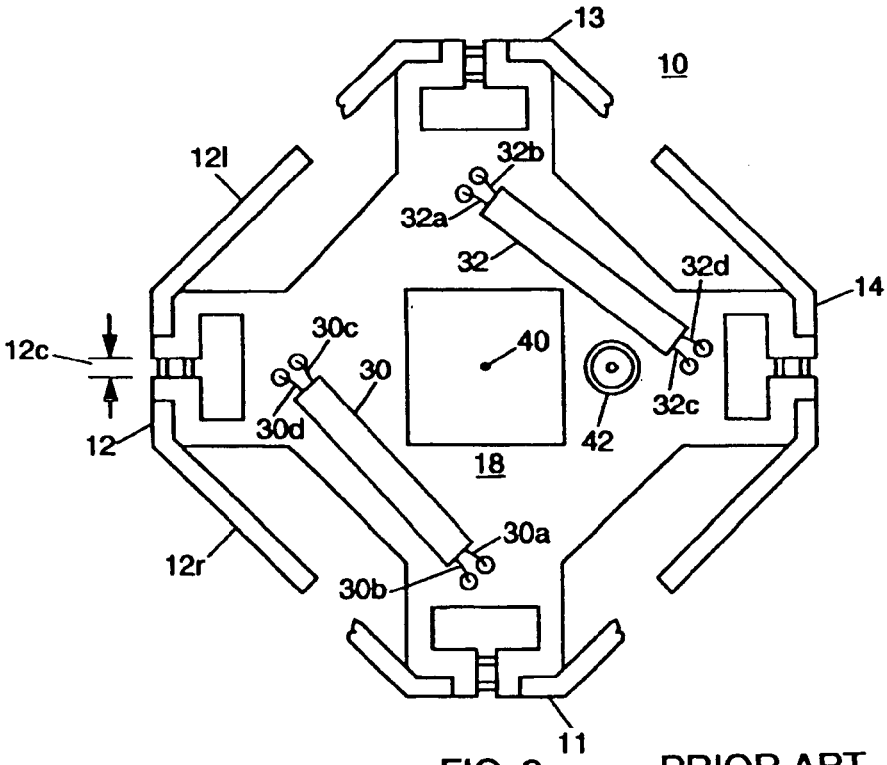
FIG. 2 PRIOR ART
FIG. 2 is a bottom view of the FIG. 1 sub-array.
Figure 3:
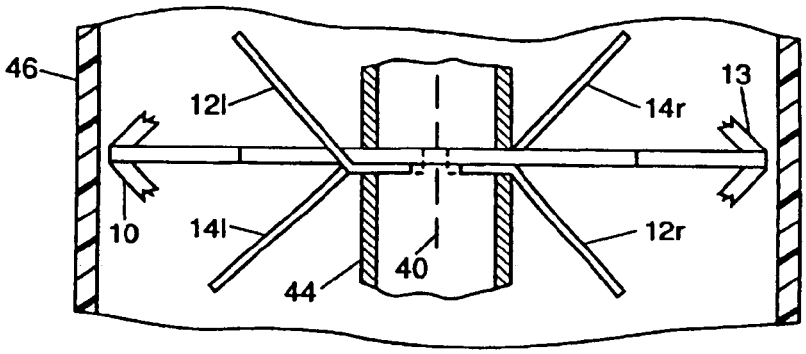
FIG. 3 PRIOR ART
FIG. 3 is a side view of the FIG. 1 sub-array.
Figure 5:
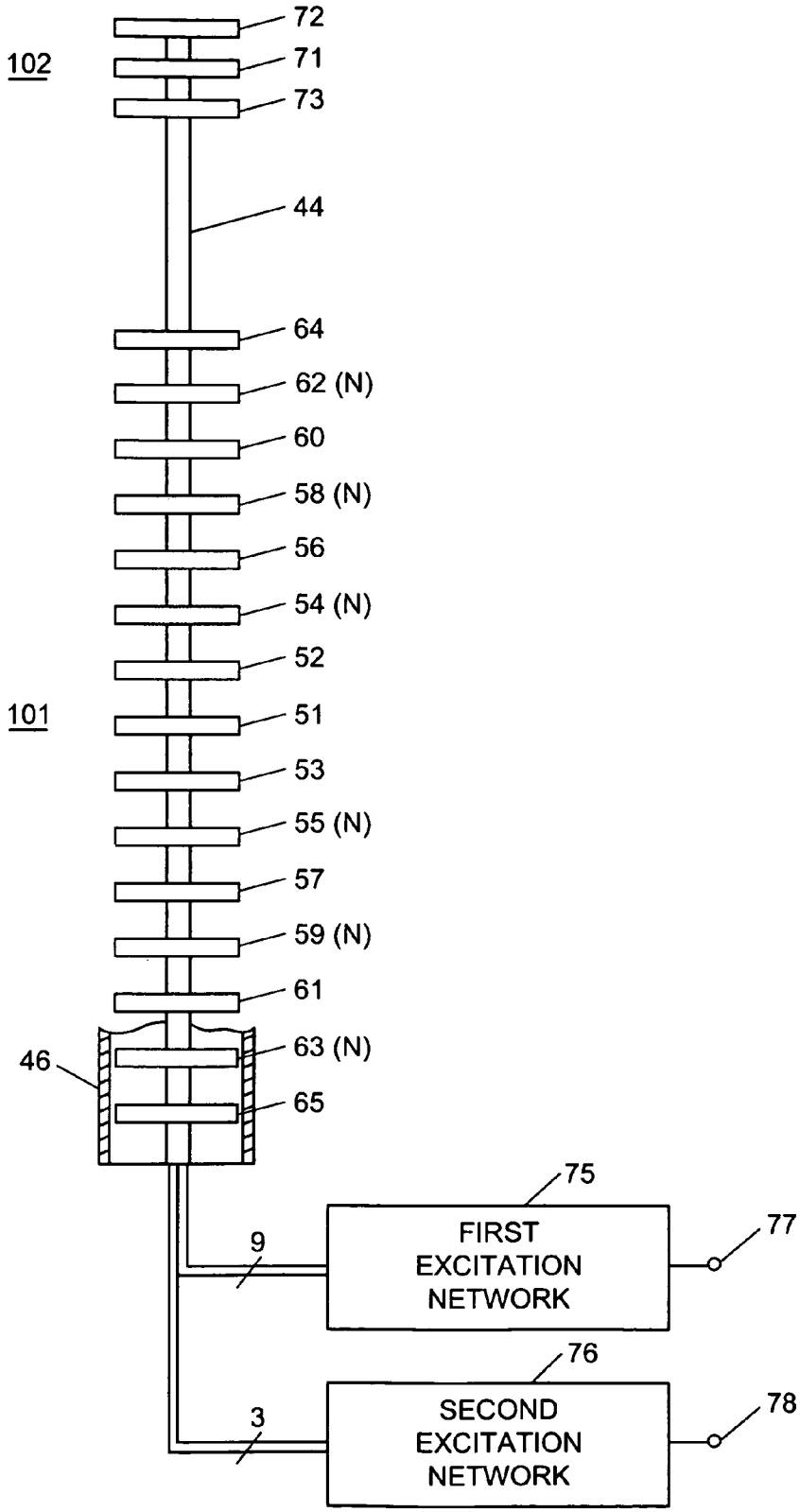
FIG. 5 shows a form of dual-array two-port GPS antenna system pursuant to the invention.

FIGS. 1, 2 and 3 are respective top, bottom and side views of a form of four-dipole sub-array usable in a dual-array two-port GPS antenna system such as shown in FIG. 5. Pursuant to the invention, the FIG. 5 dual-array antenna system is configured to provide horizon (i.e., zero degrees) to Zenith (i.e., 90 degrees) elevation coverage, with omni-directional azimuth coverage, for reception of circularly polarized signals.

FIG. 1 shows a four-dipole sub-array 10 including first, second, third and fourth dipoles 11, 12, 13, 14, respectively. Each dipole includes two opposed arms. The ends of the arms of dipoles 11 and 13, which would overlap arms of adjacent dipoles in this view, have been partially removed for clarity of illustration. In actual use, all four dipoles would typically be of substantially identical construction. This four-dipole configuration is shown and described in U.S. Pat. No. 6,201,510.

FIG. 1 illustrates an implementation using printed circuit techniques. In FIG. 1, conductor configurations are supported on the top surface of an insulative layer or substrate 16. The bottom view of FIG. 2, shows the bottom surface of a conductive (e.g., copper) layer 18 adhered to substrate 16. In this embodiment, individual arms of the dipoles (e.g., arms 12*l* and 12*r* of second dipole 12) are separately fabricated and soldered or otherwise attached at appropriate positions to the conductive layer 18. At particular locations, circuit connections pass through openings in conductive layer 18 and substrate 16 to circuit portions above. At other locations circuit connections pass through substrate 16 from above to make conductive contact with layer 18, which represents ground potential. Sub-array 10 includes a square central cutout suitable to receive a square conductive member and other cutouts to be described.

As shown in the FIG. 3 side view of the FIG. 1 four-dipole sub-array, opposed arms 12*l* and 12*r* of dipole 12 extend respectively upward and downward at approximately 45° diagonally to horizontal. Arms 14*l* and 14*r* of dipole 14, at the back of configuration 10 in the view of FIG. 3, are also visible. The four dipoles 11, 12, 13, 14 are successively spaced around a vertical axis 40, shown dashed in FIG. 3 and in end view in FIGS. 1 and 2. Dipole arms are labeled l and r, representing the left arm and right arm of a particular dipole when viewed from vertical axis 40 (i.e., viewed from a position above the top surface of element 10, looking outward from axis 40).

Four-dipole sub-array 10 includes a port illustrated as coaxial connector 42. Connector 42 is shown in FIGS. 2 and 3 with its outer conductor portion mounted to conductive layer 18 and its center conductor passing through layer 18 to the upper surface of substrate 16.

Sub-array 10 also includes a progressive-phase-omnidirectional (PPO) excitation network coupled between port 42 and dipoles 11, 12, 13, 14. As illustrated, the PPO network includes first and second quadrature couplers 30 and 32, respectively, as shown in FIG. 2 and first and second transmission line sections 34 and 36, respectively, as shown in FIG. 1. Couplers 30 and 32 in this embodiment are wireline quadrature couplers having an external encasement which is soldered or otherwise grounded to conductive layer 18. Each wireline device is a 3 dB coupler having four signal port conductors: input port "a"; output port "b" providing signals of the same phase as input signals; output port "c" providing signals of quadrature phase (i.e., 90 degree phase lag relative to input signals); and port "d" which is resistively terminated (e.g., 50 ohms to ground). While signal input terminology is used for convenience, it will be understood that the couplers operate reciprocally for the present signal reception application.

Considering both the bottom view of FIG. 2 and the top view of FIG. 1, it will be seen that port a conductor 30*a* of wireline coupler 30 is coupled through layers 18/16 and coupled to signal port 42 via line section 34. Port b conductor 30*b* is coupled through layers 18/16 and coupled to the left arm of first dipole 11, via conductor 11*a*, to provide first dipole excitation of a first phase. Conductor 11*a* and associated shorted stub 11*b* (connected to layer 18 through layer 16) are appropriately dimensioned to provide suitable impedance matching to the dipole using known design techniques. Similarly, port c conductor 30*c* is coupled to the left arm of second dipole 12 via conductor 12*a* to provide second dipole excitation of a quadrature phase (i.e., differing by 90 degrees). Port d conductor 30*d* passes through layers 18/16 and is terminated by a 50 ohm chip resistor 30*e* mounted on the surface of layer 16 and grounded to layer 18.

Second wireline quadrature coupler 32 is correspondingly coupled to third and fourth dipoles 13 and 14, however, in this case couplings are to the right arms of dipoles 13 and 14 (rather than to the left arms, as above). Thus, port a conductor 32*a* of coupler 32 is coupled to signal port 42 via second transmission line section 36. Port b conductor 32*b* (zero phase) is coupled to the right arm of third dipole 13, via conductor 13*a*, with the phase reversal from opposite-arm excitation (i.e., via right arm v. left arm above) resulting in third dipole excitation of a phase opposite (i.e., differing by 180 degrees) to the first phase excitation of first dipole 11 (e.g., 180 degrees lag). Port c conductor 32*c* (quadrature phase) is coupled to the right arm of fourth dipole 14, via conductor 14*a*, with the quadrature phase and phase reversal from opposite arm excitation resulting in fourth dipole excitation of a phase opposite to the second phase excitation of second dipole 12 (e.g., 180 degrees lag). Port d conductor 32*d* is resistively terminated via chip resistor 32*e*. Shorted stubs 12*b*, 13*b*, and 14*b* as shown are provided for dipoles 12, 13 and 14 as discussed above with reference to stub 11*b*.

During signal reception, this sub-array configuration is effective to provide at signal port 42 a signal representative of reception via a 360 degree PPO azimuth antenna pattern. Thus, the PPO network is effective to provide relative signal phasing of zero, −90, −180 and −270 degrees at first, second, third and fourth dipoles 11, 12, 13, 14, respectively, with received signals combined to provide the PPO signal at port 42. The four-dipole configuration 10 thus operates as a self-contained unit to provide this PPO capability.

For effective GPS operation, the four-dipole sub-array as configured in FIGS. 1–3 is double tuned for operation at two GPS frequencies of 1,572.42 MHZ and 1,227.6 MHZ. With reference to second dipole 12, double tuning is provided by a tuned circuit utilizing the inductance of a stub comprising gap 12*c* backed up by a rectangular opening in conductive layer 18, in combination with capacitive stub 12*d* connected to layer 18 and overlying a portion of dipole 12. Provision of this tuned circuit enables the dipole to be double tuned using known design techniques, to enable reception at both GPS signal frequencies.

In a presently preferred embodiment, four-dipole sub-array 10 is fabricated as a self-contained unit using printed circuit techniques, with the dipole arms, wireline quadrature couplers and coaxial connector soldered in place. For GPS application, the sub-array 10 has dimensions of approximately three and a quarter inches across and an inch and a quarter in height. The sub-array is shown slightly enlarged and some dimensions may be distorted for clarity of presentation. The square central opening is dimensioned for placement on a square conductive member 44 of hollow construction (e.g., a square aluminum vertical support or mast shown sectioned in FIG. 3) with electrical connection of ground layer 18 to the member 44.

Figure 4A:
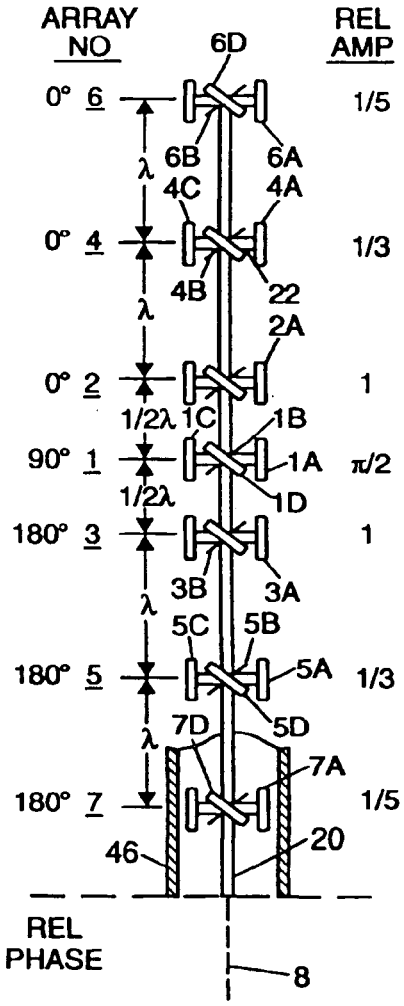
FIG. 4a PRIOR ART
FIG. 4*a* and FIG. 4*b* illustrate an antenna system including an array of seven sub-arrays, each of which may be of the type shown in FIG. 1.

Reference is made to FIG. 4*a* which illustrates a form of antenna system described in U.S. Pat. No. 5,534,882 (the '882 patent). The FIG. 4*a* antenna system is arranged to provide a first circular polarization characteristic (e.g., right circular polarization) horizontally and upward from the horizon.

Figure 4B:
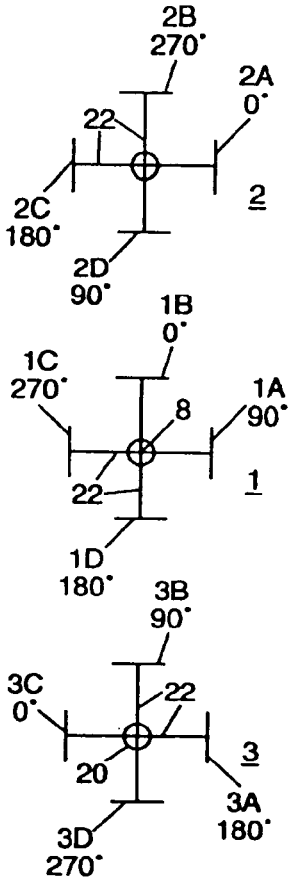
FIG. 4b PRIOR ART

Referring to the FIG. 4*a* antenna system, a mast 20 supporting the antenna system is shown centered on the vertical axis 8 and normal to the horizontal plane. As illustrated, the antenna system includes a plurality of sub-arrays, shown as sub-arrays 1–7, spaced along mast 20. Considering sub-array 1, it consists of four dipoles each supported by coupling means illustrated as a base portion (such as shown at 22 with respect to dipole 1A) extending from mast 20. As shown for dipole ID, each dipole is tilted so that its arm portions are at an angle of approximately 45 degrees. In FIG. 4*a* dipole ID is in the front (permitting its tilted orientation to be seen), side dipoles 1A and 1C are seen in side profile and rear dipole 1B is shown in simplified form as a tilted line (to distinguish it from front dipole ID). The A, B, C, D dipole labeling is typical for each of the other dipole arrays 2–7. The FIG. 4*a* antenna system looks the same when viewed from the front, the back or either side. Thus, except for the specific dipole labels as shown, FIG. 4*a* may be considered a front, back or side view. FIG. 4*b* shows simplified top views of sub-arrays 1, 2, and 3 of the FIG. 4*a* antenna, illustrating the symmetrical character of the four dipoles of each sub-array. As shown, the four dipoles of each sub-array are equally spaced around the mast 20 at 90 degree angular increments. The boresight of each dipole is thus aligned at an azimuth angle differing from the boresight angle of each other dipole in its sub-array by an integral multiple of 90 degrees.

In overview, it will thus be seen that each sub-array provides a PPO antenna pattern, however, the signal phasing at sub-arrays 2 and 3 have respectively been rotated forward (lead) and backward (lag) by 90 degrees relative to the signal phasing of sub-array 1.

As a result of excitation as described, with four 45 degree angled dipoles positioned symmetrically around mast 20 and supplied with signals as described, sub-array 1 will be effective to produce a right circular polarized radiation pattern around axis 12 which has a 360 degree PPO characteristics, as indicated by the relative phasing shown for dipoles 1A, 1B, 1C and 1D in FIG. 4*b*. Similarly, signals are coupled to the dipoles of the second sub-array of relative phase effective to produce a second PPO radiation pattern around axis 12 similar to the first such pattern, but which is shifted in azimuth by an angle of 90 degrees (i.e., 90 degrees phase lag) and to dipoles 3A, 3B, 3C and 3D to produce a similar 360 degree third PPO radiation pattern also shifted in azimuth relative to the first such pattern (i.e., 90 degrees phase lead). Additional arrays (e.g., some or all of arrays 4, 5, 6 and 7, plus additional similar arrays as suitable in particular applications) may be included and excited to provide appropriately aligned 360 degree circularly polarized PPO radiation patterns. Additional details as to the feed configuration, construction and operation of the FIG. 4*a* antenna system are provided in the '882 patent.

Referring now to FIG. 5 there is illustrated one embodiment of a dual-array GPS antenna system usable to provide omnidirectional horizon to zenith reception for differential GPS ground applications. A vertically-extending structure 44 is shown aligned vertically with a central axis 40 and may be mast or other suitable structural support member of square, round or other suitable cross-section.

The antenna system as shown in FIG. 5 includes a lower array 101 of fifteen sub-arrays 51, 52, 53, 54, 55, 56, 57, 58, 59, 60, 61, 62, 63, 64, 65 supported by structure 44 at vertically spaced positions. As shown, sub-array 51 is the center sub-array, with seven lower sub-arrays identified by odd reference numbers and seven upper sub-arrays identified by even reference numbers. For a predetermined design frequency of 1575.42 MHZ, spacing along support 44 between individual ones of the sub-arrays 50–65 (i.e., sub-array vertical centerline to such centerline of each adjacent sub-array) may be approximately 86 mm, or nominally 0.45 wavelength at the design frequency. The term "nominally" is defined as indicating that a parameter is within plus or minus twenty percent of a stated value or relationship.

Also included is an upper array 102 of three sub-arrays 71, 72, 73 supported by structure 44 and each configured to provide a PPO azimuth pattern. As shown, sub-array 71 is the middle sub-array, with sub-arrays 73 and 72 as respective bottom and top sub-arrays. For the above referenced design frequency, spacing along support 44 between individual ones of the sub-arrays 71–73 may be approximately 63 mm, or nominally 0.33 wavelength at the design frequency. In this embodiment, the spacing along support 44 between the lowest sub-array 65 and the highest sub-array 72 may be approximately 1,720 mm or nominally 9 wavelengths.

The FIG. 5 antenna system further includes a first excitation network 75 coupled to the sub-arrays 51, 52, 53, 56, 57, 60, 61, 64, 65 of the lower array 101 and arranged to provide an elevation pattern with elevation angle coverage nominally from horizon up to at least a predetermined elevation angle (e.g., from zero degrees up to 55 degrees or more in elevation) in this example.

In this embodiment, sub-arrays 54, 55, 58, 59 of the lower array 101 are not coupled to any excitation network and each may be suitably terminated. These sub-arrays, which are identified in FIG. 5 by the letter (N), may be considered as parasitic type elements functioning in known manner consistent with the overall antenna design.

As shown, second excitation network 76 is coupled to the sub-arrays 71–73 of the upper array 102 and arranged to provide an elevation pattern with elevation coverage nominally from zenith down to at least that predetermined elevation angle (e.g., from 90 degrees down to 55 degrees or less in elevation) in this example. Typically, the elevation angle coverages of the upper and lower arrays 102 and 101 will overlap, so as to provide continuous horizon to zenith elevation reception. As represented in FIG. 5, cables or conductors from the individual sub-arrays pass within the interior of structure 44, with nine (9) transmission paths from sub-arrays 51, 52, 53, 56, 57, 60, 61, 64, 65 indicated as connecting to first excitation network 75 and three (3) transmission paths from sub-arrays 71–73 indicated as connecting to second excitation network 76.

In the FIG. 5 configuration, each of sub-arrays 51–65 of lower array 101 and 71–73 of upper array 102 may comprise four dipoles positioned at different azimuth locations and configured to enable use for reception of signals of nominally circular polarization. Thus, each such sub-array may be of the type shown in FIG. 1 or of other form suitable for a particular implementation.

As shown in FIG. 5, the antenna system may further include a first signal port 77 coupled to lower array 101 via first excitation network 75 and a second signal port 78 coupled to upper array 102 via second excitation network 76. A two-port arrangement is thus provided, whereby signals received via upper array 102 are accessible via port 78 and signals received via lower array 101 are accessible via port 77. Operationally, each of ports 77 and 78 may be coupled to a suitable receiver (not shown) to provide for processing of received signals using known techniques.

In a presently preferred embodiment, a desired elevation pattern with elevation angle coverage nominally from zenith (90 degrees) down to at least 55 degrees elevation (e.g., 55 degrees or less in elevation) is achieved by upper array 102 via an antenna configuration having parameters as follows. As to the bottom (73), middle (71) and top (72) sub-arrays of array 102, bottom sub-array 73 is arranged to provide a PPO azimuth pattern which leads the PPO azimuth pattern of sub-array 71 by a nominally 90 degree azimuth phase differential, and sub-array 72 is arranged to provide a P.O. azimuth pattern which lags the P.O. azimuth pattern of sub-array 71 by a nominally 90 degree azimuth phase differential. With use of sub-arrays of the FIG. 1 type, this may be accomplished by suitable rotational placement of the sub-arrays on structure 44, as discussed above. In other implementations azimuth pattern orientation differentials may be implemented by skilled persons as appropriate. In addition, in such preferred embodiment, the second excitation network 76 may be arranged to provide relative voltage amplitude excitations of 1.0 for middle sub-array 71 and 0.56 for each of the bottom and top sub-arrays 73 and 72. These and other relative sub-array excitation values may be implemented by skilled persons, as appropriate for particular applications. It will be appreciated that, while excitation terminology may apply to signal transmission, reciprocal operation pertains with applicability also to the reception of signals.

Such embodiment may include a lower array 101 as in FIG. 5 providing a desired elevation pattern with elevation angle coverage nominally from horizon (zero degrees) up to at least 55 degrees elevation (55 degrees or more in elevation) by an antenna configuration having parameters as follows. The lower sub-arrays 53, 57, 61, 65 are arranged to each provide a PPO azimuth pattern which leads the PPO azimuth pattern of center sub-array 51 by a nominally 90 degree azimuth differential and the upper sub-arrays 52, 56, 60, 64 are arranged to each provide a PPO azimuth pattern which lags the PPO azimuth pattern of center sub-array 51 by a nominally 90 degree azimuth differential. As discussed, such azimuth pattern orientation differentials may be provided by rotational placement of the individual sub-arrays or by other suitable arrangements. As for the upper array, the first excitation network 75 may be arranged to provide relative voltage amplitude excitations of a reference level for center sub-array 51 and lower level excitations for the lower and upper sub-arrays of lower array 101. Examples of tapered relative excitation values are shown to the right of FIG. 4*b* and are discussed in U.S. Pat. No. 6,201,510 with reference to FIG. 7 thereof. Specific relative excitation values for the sub-arrays of a lower array may be as disclosed in U.S. Pat. No. 6,201,510 for corresponding elements of the FIG. 7 antenna or may be as determined by skilled persons as appropriate for particular implementations.

Figure 6:
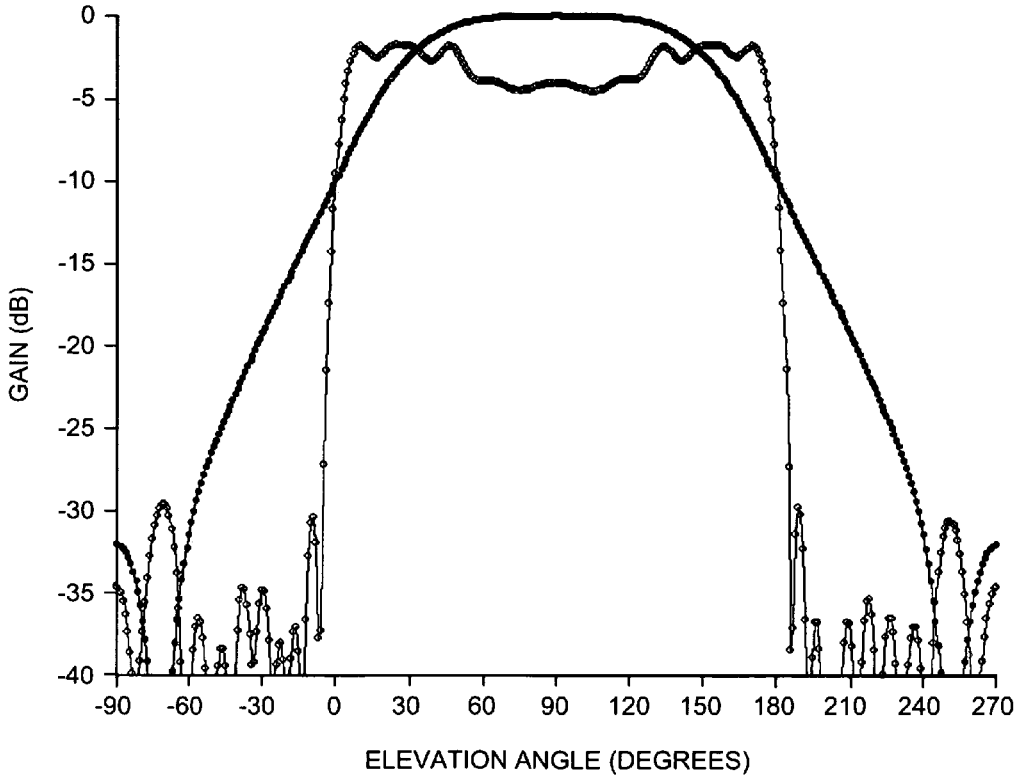
FIG. 6 is a computer generated antenna pattern showing antenna gain versus elevation angle on a total radiation basis.

FIG. 6 includes computer generated elevation radiation patterns for the upper and lower arrays of the FIG. 5 antenna system, showing total radiation levels. As shown, the lower array provides strong performance from horizon to at least 55 degrees elevation and the upper array provides strong complementary performance from zenith down to about 30 degrees elevation.

Figure 7:
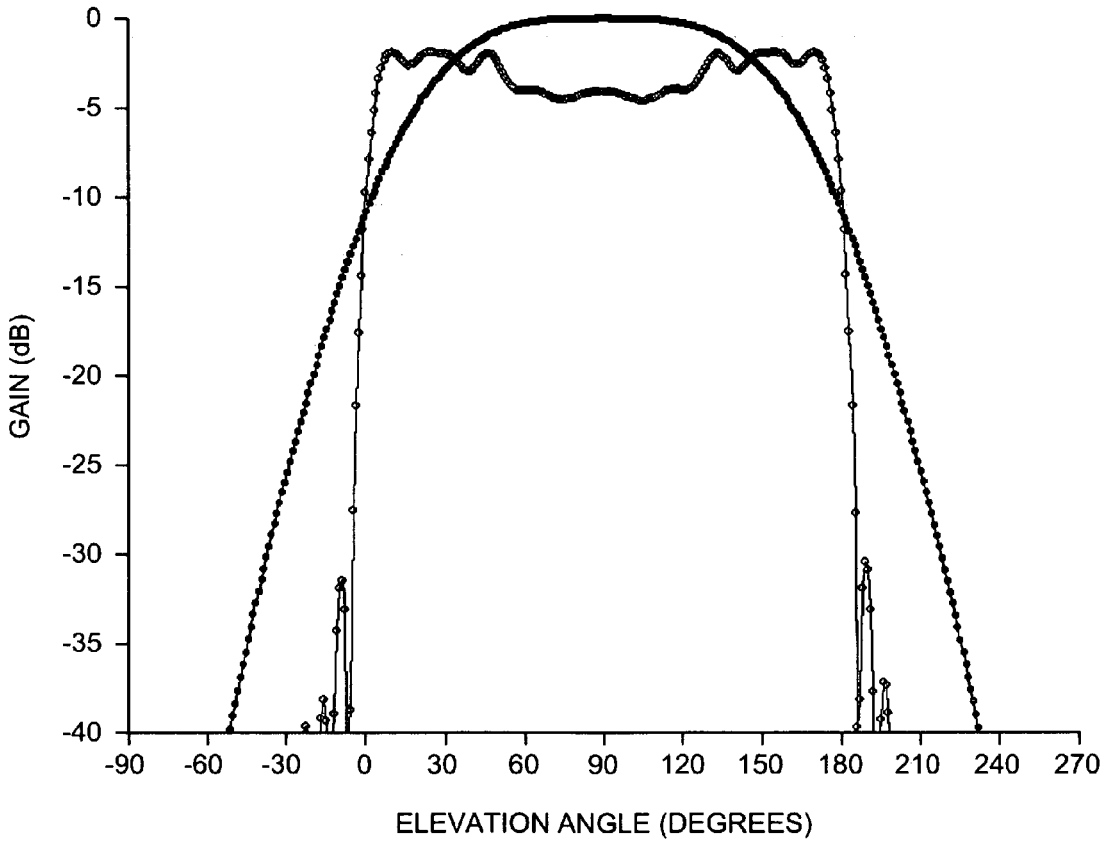
FIG. 7 is an antenna pattern similar to FIG. 6, for reception of signals of right circular polarization.

FIG. 7 includes similar patterns computed for reception of circularly polarized signals, showing reduction of sidelobe levels.

Figure 8:
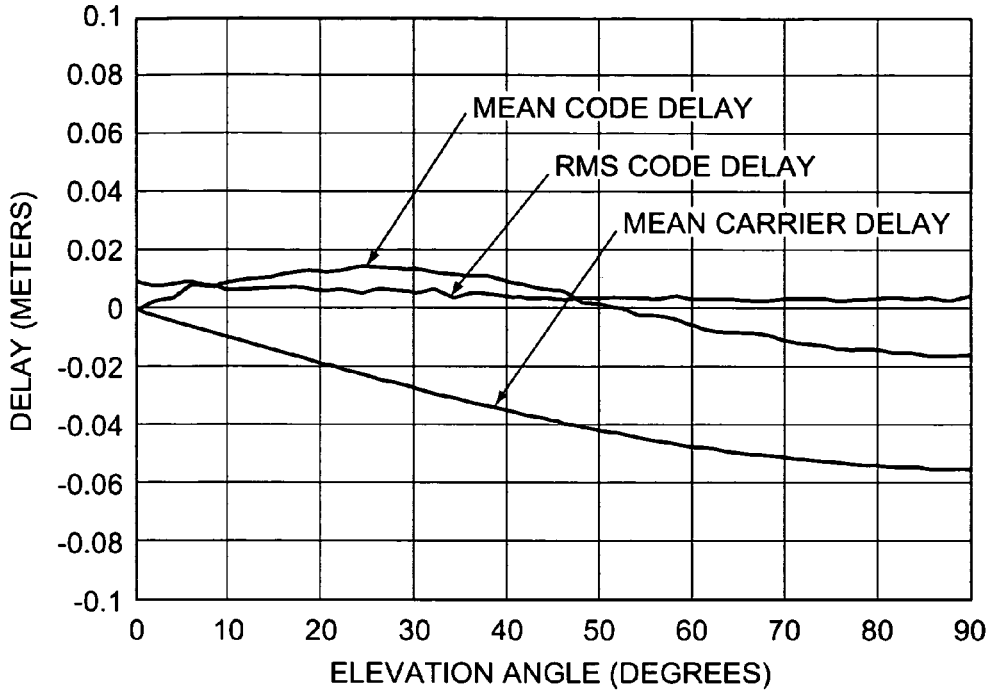
FIG. 8 provides computer generated data for the upper array, indicating the code delay center to occur at the center sub-array.

FIG. 8 includes computer generated data for delay versus elevation angle for the upper array 102 of the FIG. 5 antenna system, showing data for Mean Code Delay, RMS Code Delay and Mean Carrier Delay. In FIG. 8 data is presented with respect to a code delay characteristic of the upper array and indicates that the code delay center for the upper array occurs at the center sub-array of the upper array for the differential GPS application.

Figure 9:
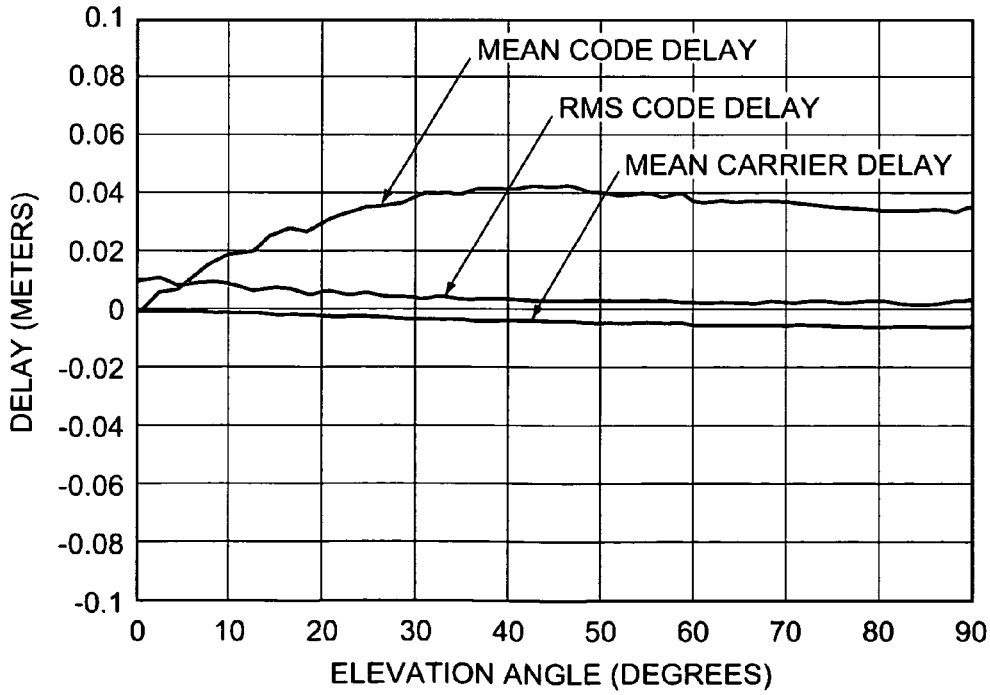
FIG. 9 provides computer generated data for the upper array, indicating the carrier delay center to occur 55 mm above the center sub-array.

FIG. 9 presents corresponding data with respect to a carrier delay characteristic of the upper array and indicates that the carrier delay center for the upper array occurs 55 mm above the center sub-array of the upper array.

Figure 10:
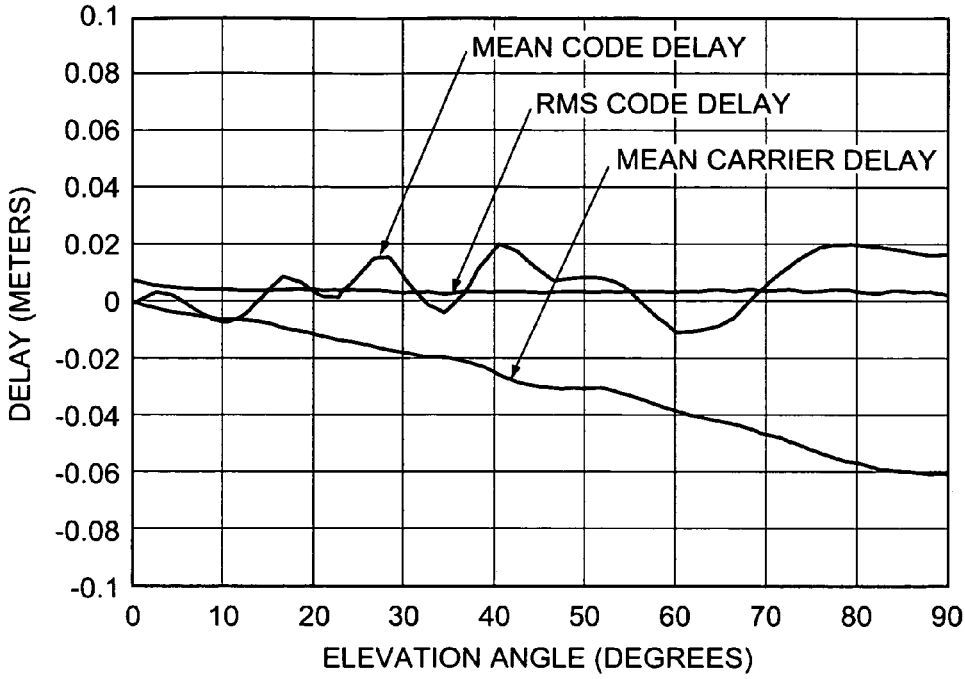
FIG. 10 provides computer generated data for the lower array, indicating the code delay center to occur 40 mm above the middle sub-array.

FIG. 10 presents corresponding data with respect to a code delay characteristic of the lower array 101 and indicates that the code delay center for the lower array occurs 40 mm above the center sub-array of the lower array.

Figure 11:
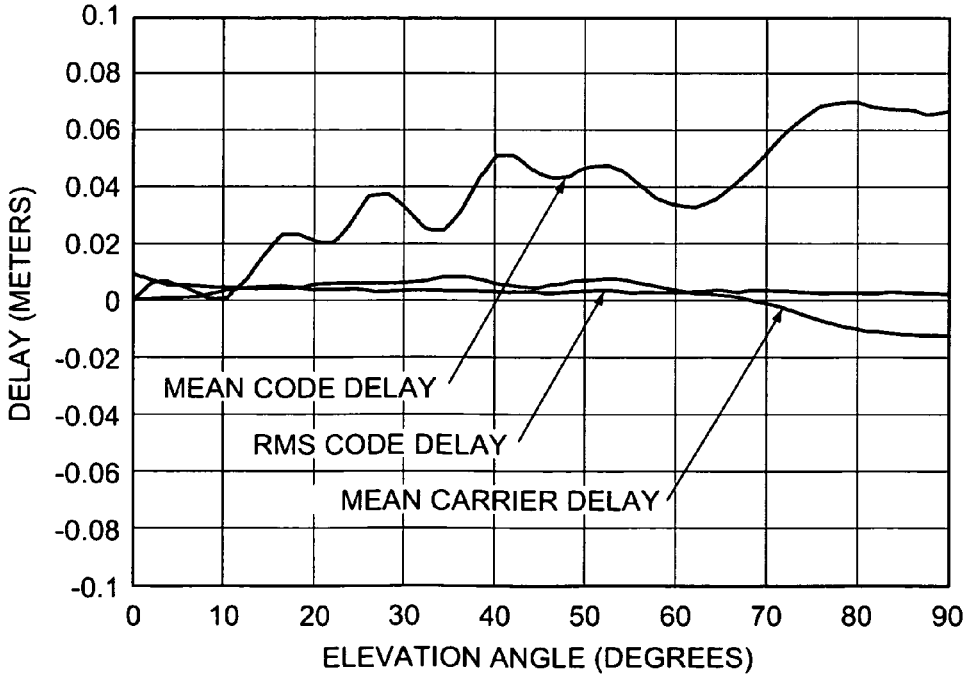
FIG. 11 provides computer generated data for the lower array, indicating the carrier delay center to occur 10 mm below the middle sub-array.

FIG. 11 presents corresponding data with respect to a carrier delay characteristic of the lower array and indicates that the carrier delay center for the lower array occurs 10 mm below the center sub-array of the lower array.

Antennas as shown and described herein can be configured by skilled persons as appropriate for specific applications. For example, while an integrated dual-array two-port single mast configuration is shown, the three sub-array form of upper array may be employed to provide high angle elevation coverage in combination with other types of arrays or antennas for GPS applications.

While there have been described the currently preferred embodiments of the invention, those skilled in the art will recognize that other and further modifications may be made without departing from the invention and it is intended to claim all modifications and variations as fall within the scope of the invention.

What is claimed is:

1. A dual-array GPS antenna system, usable to provide horizon to zenith reception for differential GPS applications, comprising:

a vertically-extending structure;

a lower array of sub-arrays supported by said structure at vertically spaced positions and each configured to provide a progressive-phase-omnidirectional (PPO) azimuth pattern;

a first excitation network coupled to sub-arrays of said lower array and arranged to provide an elevation pattern with elevation angle coverage nominally from horizon up to at least a predetermined elevation angle;

an upper array of three sub-arrays supported by said structure at vertically spaced positions above said sub-arrays of the lower array and each configured to provide a PPO azimuth pattern;

a second excitation network coupled to the sub-arrays of said upper array and arranged to provide an elevation pattern with elevation angle coverage nominally from zenith down to at least said predetermined elevation angle;

each said sub-array of the lower and upper arrays comprising four dipoles positioned with different azimuth orientations and configured to receive signals of nominally circular polarization;

a first signal port coupled to said first excitation network; and a second signal port coupled to said second excitation network.

2. An antenna system as in claim 1, wherein:

said lower array includes fifteen sub-arrays supported at positions with vertical spacings between sub-arrays of nominally 0.45 wavelength at a predetermined design frequency;

said three sub-arrays of the upper array are supported at positions with vertical spacings between sub-arrays of nominally 0.33 wavelength at said design frequency; and vertical spacing between the lowest and the highest of the sub-arrays of the antenna system is nominally 9.0 wavelengths at said design frequency.

3. An antenna system as in claim 1, wherein the upper array comprises bottom, middle and top sub-arrays and wherein:

said bottom sub-array is arranged to provide a PPO azimuth pattern which leads the PPO azimuth pattern of said middle sub-array by a nominally 90 degree azimuth phase differential; and said top sub-array is arranged to provide a PPO antenna pattern which lags the PPO azimuth antenna pattern of said middle sub-array by a nominally 90 degree azimuth phase differential.

4. An antenna system as in claim 1, wherein the upper array comprises bottom, middle and top sub-arrays and wherein said second excitation network is arranged to provide relative voltage amplitude excitations of 1.0 for said middle sub-array and 0.56 for each of said bottom and top sub-arrays of the upper array.

5. An antenna system as in claim 1, wherein the upper array comprises bottom, middle and top sub-arrays and wherein:

said bottom sub-array is arranged to provide a PPO azimuth pattern which leads the PPO azimuth pattern of said middle sub-array by a nominally 90 degree azimuth phase differential;

said top sub-array is arranged to provide a PPO antenna pattern which lags the PPO azimuth antenna pattern of said middle sub-array by a nominally 90 degree azimuth phase differential; and said second excitation network is arranged to provide relative amplitude excitations of 1.0 for said middle sub-array and 0.56 for each of said bottom and top sub-arrays of the upper array.

6. An antenna system as in claim 5, wherein:

said sub-arrays of the lower array are supported at positions with vertical spacings between sub-arrays of nominally 0.45 wavelength at a predetermined design frequency;

said sub-arrays of the upper array are supported at positions with vertical spacings between sub-arrays of nominally 0.33 wavelength at said design frequency; and vertical spacing between the lowest and the highest of the sub-arrays of the antenna system is nominally 9.0 wavelengths at said design frequency.

7. An antenna system as in claim 1, wherein said sub-arrays of the lower array include:

sub-arrays coupled to said first excitation network; and sub-arrays not coupled to any excitation network.

8. An antenna system as in claim 1, wherein said lower array comprises fifteen sub-arrays, including:

a center sub-array coupled to the first excitation network and configured to provide a progressive phase omnidirectional (PPO) azimuth pattern;

four lower sub-arrays each coupled to the first excitation network and arranged to provide a PPO azimuth pattern which leads the PPO azimuth pattern of said center sub-array by a nominally 90 degree phase differential;

four upper sub-arrays each coupled to the first excitation network and arranged to provide a PPO azimuth pattern which lags the PPO azimuth pattern of said middle sub-array by a nominally 90 degree phase differential; and six sub-arrays not coupled to any excitation network.

9. A dual-array GPS antenna system, usable to provide horizon to zenith reception for differential GPS applications, comprising:

a vertically-extending structure;

a lower array supported by said structure;

an upper array of three sub-arrays supported by said structure at vertically spaced positions above said lower array and each configured to provide a progressive-phase-omnidirectional (PPO) azimuth pattern;

an excitation network coupled to said sub-arrays of the upper array and arranged to provide an elevation pattern with elevation angle coverage nominally from zenith down to at least a predetermined elevation angle;

a first signal port coupled to said lower array; and a second signal port coupled to said upper array via said excitation network.

10. An antenna system as in claim 9, wherein:

each said sub-array comprises four dipoles positioned with different azimuth orientations and configured to receive signals of nominally circular polarization.

11. An antenna system as in claim 9, wherein:

said sub-arrays of the upper array are supported at positions with vertical spacings between sub-arrays of nominally 0.33 wavelength at a predetermined design frequency.

12. An antenna system as in claim 9, wherein the upper array comprises bottom, middle and top sub-arrays and wherein:

said bottom sub-array is arranged to provide a PPO azimuth pattern which leads the PPO azimuth pattern of said middle sub-array by a nominally 90 degree azimuth phase differential; and said top sub-array is arranged to provide a PPO antenna pattern which lags the PPO azimuth antenna pattern of said middle sub-array by a nominally 90 degree azimuth phase differential.

13. An antenna system as in claim 9, wherein the upper array comprises bottom, middle and top sub-arrays and wherein said excitation network is arranged to provide relative voltage amplitude excitations of 1.0 for said middle sub-array and 0.56 for each of said bottom and top sub-arrays of the upper array.

14. A dual-array GPS antenna system, usable to provide horizon to zenith reception of GPS signals, comprising:

a vertically-extending structure;

a lower array of sub-arrays fixed to said structure at positions spaced nominally 0.45 wavelength apart at a predetermined design frequency;

an upper array of three sub-arrays fixed to said structure above the lower array at positions spaced nominally 0.33 wavelength apart at said design frequency;

each said sub-array comprising four dipoles positioned with different azimuth orientations;

the lower and upper arrays spaced apart to provide a total separation between the lowest and highest of the sub-arrays of the antenna system of nominally 9.0 wavelengths at said design frequency;

a first signal port coupled to pre-determined sub-arrays of the lower array; and a second signal port coupled to the three sub-arrays of the upper array.

15. An antenna system as in claim 14, configured to comprise:

a said lower array arranged to provide an elevation pattern with elevation coverage nominally from horizon up to at least 55 degrees elevation; and a said upper array arranged to provide an elevation pattern with elevation coverage nominally from zenith down to at least 55 degrees elevation.

16. An antenna system as in claim 14, wherein each sub-array coupled to a signal port is arranged to provide a progressive-phase-omnidirectional (PPO) azimuth pattern for reception of circularly polarized signals.

17. An antenna system as in claim 16, wherein the upper array comprises bottom, middle and top sub-arrays and wherein:

said bottom sub-array is arranged to provide a PPO azimuth pattern which leads the PPO azimuth pattern of said middle sub-array by a nominally 90 degree azimuth phase differential; and said top sub-array is arranged to provide a PPO azimuth pattern which lags the PPO azimuth pattern of said middle sub-array by a nominally 90 degree azimuth phase differential.

18. An antenna system as in claim 16, additionally comprising an upper array excitation network coupled to said sub-arrays of the upper array and arranged to provide relative voltage amplitude excitations of 1.0 for said middle sub-array and 0.56 for each of said bottom and top sub-arrays of the upper array.

19. An antenna system as in claim 14, wherein the sub-arrays of said upper array comprise:

a middle sub-array arranged for reference level excitation and arranged to provide a progressive phase omnidirectional (PPO) azimuth pattern;

a bottom sub-array arranged for excitation at a level nominally 0.56 times said reference level and arranged to provide a PPO azimuth pattern which leads the PPO azimuth pattern of said middle sub-array by a nominally 90 degree phase differential; and a top sub-array arranged for excitation at a level nominally 0.56 times said reference level and arranged to provide a PPO azimuth pattern which lags the PPO azimuth pattern of said middle sub-array by a nominally 90 degree phase differential.

20. An antenna system as in claim 14, wherein said lower array comprises fifteen sub-arrays, including:

a center sub-array coupled to said first signal port and configured to provide a progressive phase omnidirectional (PPO) azimuth pattern;

four lower sub-arrays each coupled to said first signal port and arranged to provide a PPO azimuth pattern which leads the PPO azimuth pattern of said center sub-array by a nominally 90 degree phase differential;

four upper sub-arrays each coupled to said first signal port and arranged to provide a PPO azimuth pattern which lags the PPO azimuth pattern of said center sub-array by a nominally 90 degree phase differential; and six sub-arrays not coupled to any signal port.

* * * * *